US006442784B1

(12) United States Patent
Bilger

(10) Patent No.: US 6,442,784 B1
(45) Date of Patent: Sep. 3, 2002

(54) COMBINATION FOXTAIL BRUSH AND RETRACTABLE RAZOR SCRAPER

(76) Inventor: Steve Bilger, 3000 S. Platte River Dr., Englewood, CO (US) 80110

( * ) Notice: Subject to any disclaimer, the term of this patent is extended or adjusted under 35 U.S.C. 154(b) by 0 days.

(21) Appl. No.: 09/544,105

(22) Filed: Apr. 6, 2000

(51) Int. Cl.[7] ..... A46B 17/08; A47L 13/08; A47L 13/12

(52) U.S. Cl. ..... 15/111; 15/236.01

(58) Field of Search ..... 15/111, 113, 236.01; 30/125, 162, 169, 335; D4/118; D32/42, 46–49

(56) References Cited

U.S. PATENT DOCUMENTS

| | | | | | |
|---|---|---|---|---|---|
| 37,315 | A | * | 1/1863 | Whipple | 15/113 |
| 138,353 | A | * | 4/1873 | Von Kessler et al. | 15/113 |
| 203,050 | A | * | 4/1878 | Kean | 15/113 |
| 428,491 | A | * | 5/1890 | Hortman | 15/111 |
| 587,964 | A | * | 8/1897 | Henry | 15/113 |
| 623,582 | A | * | 4/1899 | Vollmar | 15/113 |
| 971,306 | A | * | 9/1910 | Pfleghardt | 15/111 |
| 1,309,599 | A | * | 7/1919 | Seaboldt et al. | 15/111 X |
| 2,533,838 | A | * | 12/1950 | Ranft | 15/111 |
| 5,009,009 | A | * | 4/1991 | Stinson | 15/236.01 X |
| 5,343,585 | A | * | 9/1994 | Howell | 15/111 |
| 5,819,355 | A | * | 10/1998 | Wu | 15/111 X |

FOREIGN PATENT DOCUMENTS

| | | | | |
|---|---|---|---|---|
| CH | 173025 | * | 2/1935 | 15/111 |
| GB | 5516 | * | 11/1890 | 15/111 |
| GB | 311878 | * | 5/1929 | 15/113 |

* cited by examiner

*Primary Examiner*—Mark Spisich
(74) *Attorney, Agent, or Firm*—Edwin H. Crabtree; Ramon L. Pizarro; Donald W. Margolis

(57) ABSTRACT

A combination foxtail brush and retractable razor blade scraper used in various types of flooring and wall construction. The combination brush and scraper eliminates the need for a separate brush and a separate scraper. The combination includes a razor blade slide slidably mounted on a handle base of a brush handle. The brush base includes a handle grip. Brush bristles are attached to and extending downwardly from the bottom of the handle base. The handle base includes a first end and an enlarged second end. A razor blade is removably attached to one end of a razor blade slide. The razor blade slide includes a push button mounted on and extending upwardly from an opposite end. A base cap is removable attached to the handle base. The base cap has a first end and an enlarged second end with wrap around sides. The wrap around sides are slidable received around the enlarged second end of the handle base. The push button of razor blade slide is received through an opening in the first end of the base cap. The push button is used for operating the razor blade slide.

14 Claims, 1 Drawing Sheet

COMBINATION FOXTAIL BRUSH AND RETRACTABLE RAZOR SCRAPER

BACKGROUND OF THE INVENTION (a) Field of the Invention

This invention relates to floor and wall scraping devices and brushes and brooms and more particularly, but not by way of limitation, to a combination foxtail brush with a razor blade scraper incorporated into a base of a brush handle.

(b) Discussion of Prior Art

U.S. Pat. No. 37,315 to Whipple discloses a shoe brush with a retractable scraper which can be extended outwardly from one end of the brush. U.S. Pat. No. 138,353 to Kessler et. illustrates a brush for blacking shoes. This patent also has a retractable scraper in the handle of the brush. U.S. Pat. No. 587,964 to Henry discloses a brush without a handle. In the top of the brush, a hoe-shaped scraper is shown which is spring biased and can be moved outwardly for various types of scraping jobs. U.S. Pat. No. 623,582 to Vollmar describes a combined blacking brush and shoe cleaner. This patent also describes a retractable scraper mounted on top of the blacking brush.

None of the above mentioned prior art brushes and retractable scrapers provide a unique combination of structure and features of the subject foxtail brush and retractable razor blade scraper for use in flooring and wall construction and various other types of applications requiring a razor blade scraper and cleaning brush combination.

SUMMARY OF THE INVENTION

In view of the foregoing, it is a primary object of the subject invention to provide a combination foxtail brush and razor blade scraper eliminating the need of having to keep on hand a separate brush and a separate razor blade scraper.

Another object of the invention is the combination tool can be used during flooring construction, wall construction, various types of building projects and other applications requiring a razor blade scraper and brush for clean up. The tool's handle may be made of high density urethane plastic and like materials. The bristles of the brush may also be made of plastic or organic material.

Still another object of the invention is the razor blade scraper includes an elongated razor blade of up to 2½ inches in width with the width of the blade matching the width of the brush handle for greater leverage in difficult clean up jobs. With the increased size of the razor blade, time and energy in cleaning and scraping are reduced.

The subject invention includes a razor blade scraper retractably mounted in a handle base of a brush handle. Bristles of the foxtail brush extend downwardly from the handle base. A first end of the handle base is widened to accommodate a razor blade having a width up to 2½ inches. The razor blade is mounted on a blade head which is part of a razor blade slide received in the top of the handle base. The razor blade slide includes a push button which is used to move the slide along the length of the handle base for retracting the razor blade on top of the handle base and extending the razor base outwardly from one end of the handle base. The razor base slide also includes a storage area in the top thereof for storing a plurality of razor blades therein. The top of the handle base and the razor blade slide are covered by a base cap. The base cap is removably attached to the handle base. The push button extends upwardly through an opening in the base cap for operating the razor blade slide.

These and other objects of the present invention will become apparent to those familiar with the different types of brushes and razor blade scrapers when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figures 1, 2:
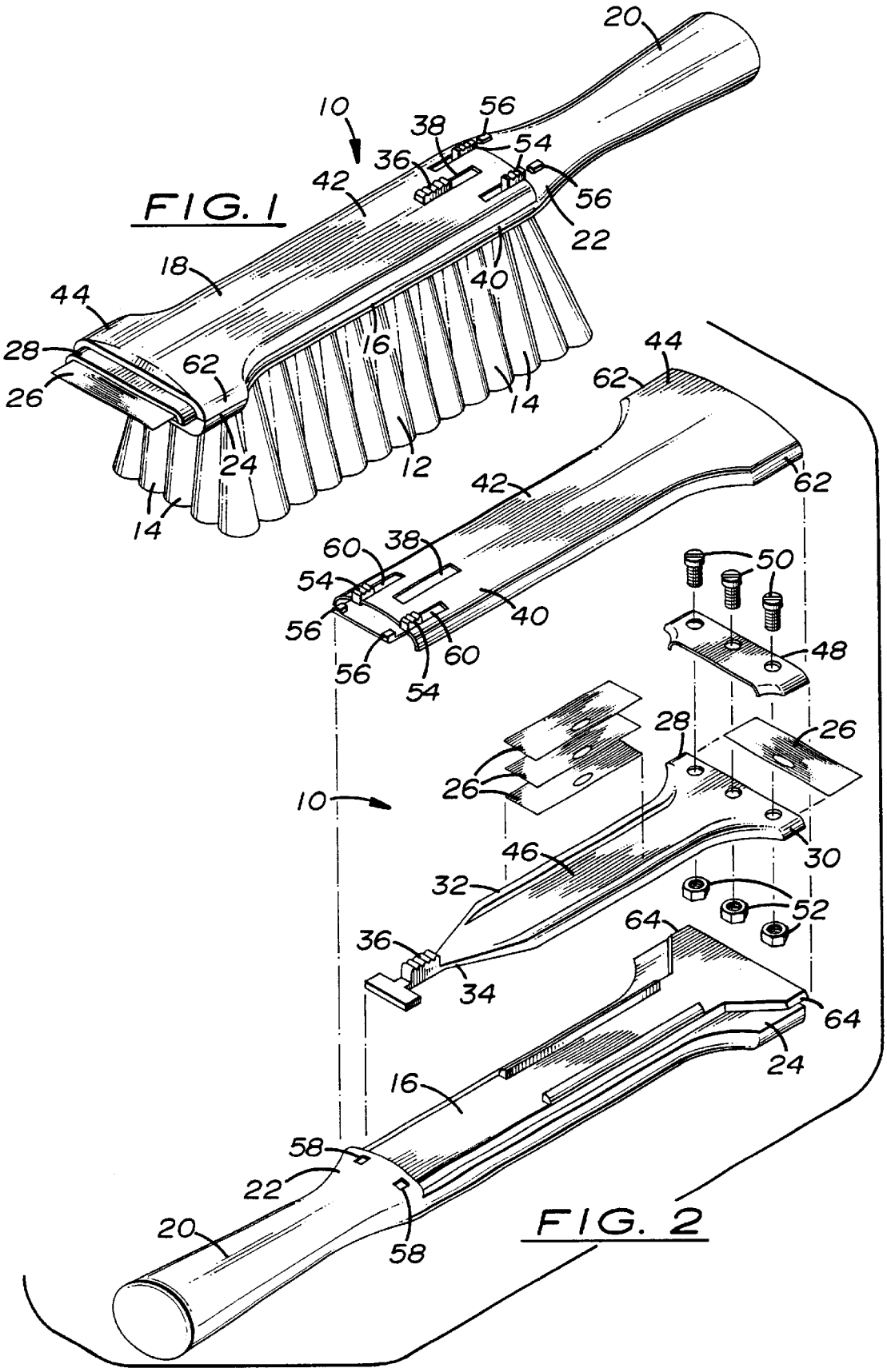
FIG. 1 is a perspective view of the combination foxtail brush and retractable razor blade scraper. In this view the combination includes a brush with a plurality of individual bristles attached to and extending downwardly from a handle base which is part of a brush handle. The brush handle also includes a handle grip incorporated into a first end of the handle base. In this drawing, a razor blade is shown extending outwardly from a second end of the handle base.
FIG. 2 is an exploded perspective view of the handle base and handle grip with a razor blade scraper with razor blades and a base cap disposed above the handle base. The razor blade scraper includes a push button which is received through a push button opening in the base cap.

In FIG. 1, a perspective view of the combination foxtail brush and retractable blade scraper is shown and having general reference numeral 10. The combination brush and scraper 10 includes a brush 12 with a plurality of individual bristles 14 attached to and extending downwardly from a handle base 16. The handle base 16 is part of a brush handle 18. The brush handle 18 includes a handle grip 20 which is incorporated into a first end 22 of the handle base 16. Extending outwardly from an enlarged second end 24 of the handle base 16 is a razor blade 26 ready for use in a scraping and cleaning application. The width of the razor blade 26 is in a range of 1 to 2½ inches. Note that the front bristles 14 flair outwardly below the razor blade 26 for cleaning difficult to reach areas such as corners where walls and floors intersect and other difficult to reach areas requiring cleaning.

The razor 26 is attached to an enlarged blade head 28 incorporated into one end 30 of a razor blade slide 32. The razor blade slide 32 includes in an opposite end 34 with an upwardly extending push button 36. The push button 36 is received through a push button opening 38 in a first end 40 of a handle base cap 42. The handle base cap 42 also includes an enlarged second end 44 which is received over the top of the razor blade 26 and the blade head 28. The razor blade slide 32 is shown in detail in FIG. 2.

In FIG. 2, an exploded perspective view of the handle base 16 and handle grip 20 is shown with the razor blade slide 32 with razor blades 26 and the handle base cap 42 disposed above the handle base 16 and ready for attachment thereto.

The razor blade slide 32 includes an elongated channel 46 along its length for receiving and storing extra razor blades 26. The extra blades 26 are for replacing the razor blade 26 attached to the enlarged blade head 28 if the razor blade 26 becomes dull or broken. The razor blade 26 is attached to the enlarged blade head 28 and compressed thereon using a blade mounting head 48 secured on top of the blade head 28. The blade mounting head 48 is attached thereto using attachment screws 50 and nuts 52. The razor blade slide 32 is operated using the push button 36 for sliding the razor blade slide 32 along the length of the handle base 16 from right to left and extending the razor blade 26 outwardly from the second end 24 of the handle base 16 as shown in FIG. 1. Obviously, by moving the push button from left to right, the razor blade 26 can be retracted onto the top of the enlarged second end 24 when the razor blade 26 is not in use and to prevent possible injury when carrying the combination brush and scraper 10.

Referring now to both FIGS. 1 and 2, the handle base cap 42 includes a pair of cap release buttons 54 with latches 56 for holding the base cap 42 on top of the handle base 16. The latches 56 are slidably received in a pair of latch holes 58 in the first end 22 of the handle base 16. By pushing the cap release buttons 54 downwardly and pushing the buttons 54 from right to left along the length of a pair of release openings 60, the latches 56 are removed from engagement inside the latch holes 58. At this time the handle base cap 42 can be moved from right to left and disengaged from the top of the base handle 16. It should be noted that the enlarged second end 44 of the base cap 42 includes wrap around sides 62 which slidably receive and hold the second end 44 around opposite sides 64 of the enlarged second end 24 of the handle base 16, when the latches 56 are received in the latch holes 58 as shown in FIG. 1.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A combination foxtail brush and retractable razor blade scraper used in various types of flooring and wall construction, the combination comprising:

a brush handle with a handle base, said handle base having a first end and a second end, the second end of said handle base enlarged for receiving a razor blade thereon, said razor blade having a width in a range of 1 to 2½ inches;

brush bristles attached to and extending outwardly from said handle base;

a razor blade slide slidably received on top of and along a length of said handle base, said razor blade attached to one end of said razor blade slide, said slide having a push button mounted on and extending upwardly from an opposite end thereof; and a base cap, said base cap releasably attached to said handle base, said push button of said slide received through an opening in said base cap, said push button used for operating said razor blade slide.

2. The combination as described in claim 1 further including means for releasably attaching said razor blade on the one end of said razor blade slide.

3. The combination as described in claim 2 wherein said means for releasably attaching said razor blade is a blade mounting head with fasteners used for securing said razor blade on said razor blade slide.

4. The combination as described in claim 1 further including means for removably attaching said base cap to said handle base.

5. The combination as described in claim 4 wherein said means for removably attaching said base cap is a pair of release buttons with latches, said latches received in latch holes in the first end of said handle base.

6. A combination foxtail brush and retractable razor blade scraper used in various types of flooring and wall construction, the combination comprising:

a brush handle with a handle base, said handle base having a first end and an enlarged second end, the second end receiving a razor blade thereon, said razor blade having a width in a range of 1 to 2½ inches;

brush bristles attached to and extending downwardly from said handle base;

an elongated razor blade slide slidably received on top of and along a length of said handle base, said razor blade removably attached to one end of said razor blade slide, said slide having a push button mounted on and extending upwardly from an opposite end thereof; and a base cap, said base cap releasably attached to the first end and the second end of said handle base, said push button of said slide received through an opening in said base cap, said push button used for operating said razor blade slide.

7. The combination as described in claim 6 further including a blade mounting head with fasteners, said mounting head and fasteners used for securing said razor blade on said razor blade slide.

8. The combination as described in claim 6 further including a pair of release buttons with latches mounted on said base cap, said latches received in latch holes in the first end of said handle base.

9. The combination as described in claim 6 wherein said razor blade slide includes an elongated channel along a length thereof, said razor blade slide adapted for receiving a plurality of extra razor blades thereon.

10. A combination foxtail brush and retractable razor blade scraper used in various types of flooring and wall construction, the combination comprising:

a brush handle with a handle base, said handle base having a first end and an enlarged second end, the enlarged second end receiving a razor blade thereon;

brush bristles attached to and extending downwardly from said handle base;

an elongated razor blade slide slidably received on top of and along a length of said handle base, said razor blade removably attached to one end of said razor blade slide, said slide having a push button mounted on and extending upwardly from an opposite end thereof; and a base cap, said base cap having a first end and an enlarged second end with wrap around sides, the wrap around sides slidably received around the second end of said handle base, said push button of said slide received through an opening in the first end of said base cap, said push button used for operating said razor blade slide.

11. The combination as described in claim 10 further including a blade mounting head with fasteners, said mounting head and fasteners used for securing said razor blade on said razor blade slide.

12. The combination as described in claim 10 further including a pair of release buttons with latches mounted on the first end of said base cap, said latches received in latch holes in the first end of said handle base.

13. The combination as described in claim 10 wherein said razor blade slide includes an elongated channel along a length thereof, said razor blade slide adapted for receiving a plurality of extra razor blades thereon.

14. The combination as described in claim 10 wherein the first end of said handle base includes a handle grip extending outwardly therefrom.

* * * * *